US005422233A

United States Patent [19]

Eckert et al.

[11] Patent Number: 5,422,233

[45] Date of Patent: Jun. 6, 1995

[54] PHOTOGRAPHIC PROCESSING COMPOSITIONS INCLUDING HYDROPHOBICALLY MODIFIED THICKENING AGENT

[75] Inventors: Robert D. Eckert, Lexington; Daniel D. Huang, Wayland; Francis M. Pierce, Groton, all of Mass.

[73] Assignee: Polaroid Corporation, Cambridge, Mass.

[21] Appl. No.: 243,974

[22] Filed: May 17, 1994

[51] Int. Cl.[6] ..... G03C 8/38; G03C 5/305

[52] U.S. Cl. ..... 430/466; 430/212; 430/215; 430/404; 252/356; 252/357; 252/363.5; 526/307.6; 526/318.4; 526/318.44

[58] Field of Search ..... 430/212, 215, 466, 404, 430/493, 627, 634; 526/307.6, 318.4, 318.44; 252/363.5, 356, 357

[56] References Cited

U.S. PATENT DOCUMENTS

| | | | |
|---|---|---|---|
| 3,929,485 | 12/1975 | Miyakawa et al. | 430/466 |
| 4,062,817 | 12/1977 | Westerman | 260/17.45 G |
| 4,202,694 | 5/1980 | Taylor | 430/215 |
| 4,294,907 | 10/1981 | Bronstein-Bonte et al. | 430/213 |
| 4,324,853 | 4/1982 | Berger | 430/245 |
| 4,397,996 | 8/1983 | Chiklis et al. | 525/380 |
| 4,421,902 | 12/1983 | Chang et al. | 526/317 |
| 4,496,651 | 1/1985 | Cerankowski et al. | 430/490 |
| 4,680,247 | 7/1987 | Murphy | 430/215 |
| 4,911,736 | 5/1990 | Huang et al. | 44/51 |
| 4,923,940 | 5/1990 | Hsu | 526/208 |
| 4,996,274 | 2/1991 | Hsu | 526/208 |
| 5,004,598 | 4/1991 | Lochhead et al. | 424/59 |

OTHER PUBLICATIONS

Lundberg, D. J., Glass, J. E., "Pigment Stabilization through Mixed Associative Thickener Interactions", *Journal of Coating Technology,* 64(807), 53–61, 1992.

Lochhead, R. Y., "Electrosteric Stabilization of Oil-in-Water Emulsions by Hydrophobically Modified Poly(acrylic acid) Thickeners", Glass, J. E., Schulz, D. N. Ed., *ACS Advances in Chemistry Series 462,* 1991, Chapter 6.

Shay, G. D., "Alkali-Swellable and Alkali-Soluble Thickener Technology", *Polymers in Aqueous Media: Performance Through Association,* Glass, J. E. Ed., *ACS Advances in Chemistry Series 223,* 1989, Chapter 25.

*Primary Examiner*—Richard L. Schilling

*Attorney, Agent, or Firm*—Edward W. Black

[57] ABSTRACT

Photographic processing compositions comprising an aqueous alkaline medium and a hydrophobically modified thickening agent are disclosed. The subject thickening agent increases the viscosity of the processing composition while maintaining a relatively uniform homogenous mixture of the constituents thereof. The subject processing compositions are useful in photographic diffusion transfer film units and processes.

13 Claims, 1 Drawing Sheet

PHOTOGRAPHIC PROCESSING COMPOSITIONS INCLUDING HYDROPHOBICALLY MODIFIED THICKENING AGENT

BACKGROUND OF THE INVENTION

1. Technical Field

The subject invention relates to photographic processing compositions, film units, and processes for use in photographic diffusion transfer systems. More particularly, the subject invention relates to products and processes utilizing aqueous alkaline processing compositions including thickening agents therein.

2. Description of the Related Art

Diffusion transfer photographic products and processes have been described in the art and details relating to such products and processes can be found in numerous references, e.g. U.S. Pat. Nos. 2,983,606; 3,415,644; 3,594,165; 3,647,437; Great Britain Pat. No. 1,220,524; and chapter 6 of *Imaging Processes and Materials*, Neblette's Eight Edition, Van Nostrand Reinhold, N.Y., 1989, entitled "Instant Photography Related Reprograph Processes." In general, diffusion transfer photographic products include film units having a photosensitive system including at least one silver halide emulsion layer usually integrated with an image-providing material. After photoexposure, the photosensitive system is developed to establish an imagewise distribution of a diffusible image-providing material, at least a portion of which is transferred by diffusion to an image-receiving layer capable of mordanting or otherwise fixing the transferred image-providing material. In some diffusion transfer products, the transfer image is viewed by reflection after separation of an image-receiving element from the photosensitive system. Such products are often referred to as "peel-apart" film units. In other diffusion transfer products, such separation is not required and the transfer image is viewed against a reflecting background, usually provided by a dispersion of a white, light-reflecting pigment such as titanium dioxide. Such products are often referred to as "integral negative-positive" film units or simply "integral" film units.

A number of integral photographic products and processes have been proposed for providing diffusion transfer photographic images retained as part of a permanent laminate. Typically, such a photographic laminate will comprise a pair of outer polymeric layers, e.g., polyester, having therebetween a developed photosensitive system and a suitable image-carrying layer. In such products, the image-carrying layer is separated from the developed silver halide photosensitive system by a light-reflecting layer (e.g., a layer containing titanium dioxide positioned between the developed silver halide emulsion system and the image-carrying layer) and at least one of the outer polymeric layers is transparent to permit viewing of the photographic image against the light-reflecting layer.

In the processing of certain preferred integral diffusion transfer film units, it has been customary to effect photographic development with the aid of an aqueous alkaline processing composition including a light-reflecting agent, e.g. titanium dioxide. Such a processing composition is typically spread from a rupturable container by passage of the film unit between a pair of rollers to distribute a layer of processing composition between the sheet elements of the film unit. The distributed layer of processing composition forms a light-reflecting layer which provides a background for viewing of the photographic image and upon drying, may also serve to bond the layers of the film unit together to form the desired permanent laminate. Photographic processing compositions suited to such purposes are described, for example, in U.S. Pat. Nos. 3,415,644; 3,597,197; 3,679,409; 3,647,437; 4,202,694; 4,294,907; 4,324,853; 4,397,996; 4,496,651; and 4,680,247. As is pointed out in these patents, a thickening agent, (also referred to as a viscosity-increasing reagent/agent or viscosity-imparting reagent/agent), is usually included in such processing compositions to facilitate uniform spreading of the composition, e.g., a polymeric film-forming material such as sodium carboxymethyl cellulose, hydroxyethyl carboxymethyl cellulose, hydroxyethyl cellulose, carboxymethyl cellulose, polymeric oximes such as polydiacetone acrylamide oxime, and various blends thereof.

It is important that the thickening agents remain stable, that is, not hydrolyze, in the typically high pH of the processing composition. Furthermore, thickening agents must have stable shelf lives and absorb as little light as possible, thereby not significantly contributing to the minimum optical density ($D_{min}$) of the film unit. With these concerns in mind, polyacrylic acid thickening agents, such as Carbopol 940 TM (available from B. F. Goodrich, Specialty Polymers and Chemicals Division), have been used as thickening agents in processing composition resulting in improved shelf lives and reduced minimum optical density values.

A continual concern with processing compositions is phase separation of the constituents of the processing composition; that is, a condition wherein heterogenous layers of the constituents of the processing composition form, e.g. between a light-reflecting pigment-rich phase and other constituents of the composition. Typically such a phase separation forms in the rupturable container and is referred to as "pooling." This separation of constituents manifests itself when the processing composition is spread between the sheet elements of the film, and may result in an inconsistently developed photograph which includes portions having inaccurate image and color formation due to non-uniform development.

Efforts to eliminate pooling of the processing composition can be difficult without detrimentally affecting photographic quality of a film unit. That is, due to complexity of the chemical interactions between the constituents of the composition, minor changes in the formulation of the processing composition can have a significant impact on the resulting photographic product.

SUMMARY OF THE INVENTION

The present invention is directed toward photographic diffusion transfer products and processes, and particularly, photographic processing compositions used therewith. The subject invention includes a photographic processing composition comprising an aqueous alkaline medium having therein a hydrophobically modified thickening agent for increasing the viscosity of the composition. The thickening agent comprises a copolymer polymerized from a monomer system comprising:

(a) carboxylic acid monomers, the same or different, selected from the group consisting of: acrylic acid, methacrylic acid, ethacrylic acid, propacrylic acid and butacrylic acid; and (b) hydrophobe monomers, the same or different, represented by the formula:

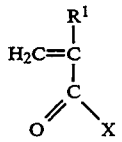

wherein $R^1$ is selected from hydrogen and alkyl having from 1 to 4 carbon atoms; and X is selected from —O—$R^2$ and —$NR_3R^4$ wherein $R^2$ is selected from: aralkyl, alkaryl, and alkyl wherein the alkyl portion of each group comprises from 8–30 carbon atoms; $R^3$ is selected from methyl and hydrogen; and when $R^3$ is methyl, $R^4$ is an alkyl group consisting of 1–18 carbon atoms; and when $R^3$ is hydrogen, $R^4$ is a tertiary alkyl group consisting of 4 to 18 carbon atoms wherein the carbon atom of attachment of the alkyl group is tertiary.

An advantage of the present invention is pooling of the constituents of the processing composition is reduced.

A further advantage of the present invention is photographic film units having improved photographic quality.

DETAILED DESCRIPTION OF THE INVENTION

Figure 1:
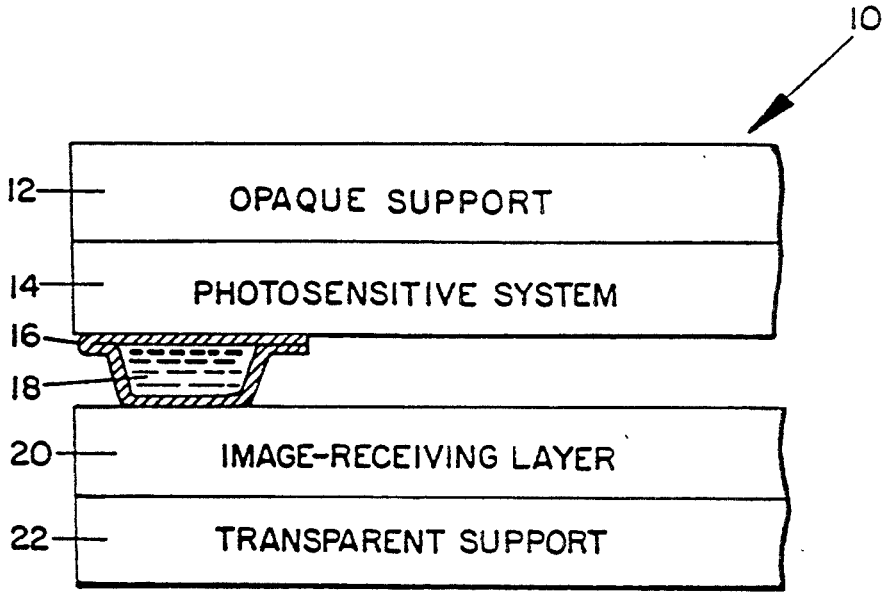
FIG. 1 is an enlarged schematic cross-sectional view of an arrangement of essential elements of a preferred film unit of the present invention.

The present invention is directed toward photographic diffusion transfer products and processes. The present invention is applicable to products and processes wherein an image-receiving layer is separated from a photosensitive layer(s), (i.e. "peel-apart" film units), and those products and processes wherein a layer containing a diffusion transfer image, is not separated from the developed photosensitive layers after processing but is retained with the developed photosensitive layers as part of a permanent laminate, i.e. "integral film units."

Integral film units generally include a light-reflecting layer including a light-reflecting pigment positioned in the laminate between the developed photosensitive layer or layers and the image-carrying layer which serves to mask the developed photosensitive layer or layers and provides a light-reflecting background against which the photographic image can be viewed. These layers are part of a permanent laminate which includes outer or support layers at least one of which is transparent to permit the viewing therethrough of the photographic image.

The light-reflecting layer may be provided in the photographic laminate as the result of the spreading between the photographic emulsion layer (or layers) and the image-receiving layer of the photographic film unit, a processing composition including the light-reflecting pigment and a thickening agent. The layer of processing composition distributed during processing of the film unit forms the light-reflecting layer which also may be designed so as to bond the layers of the film unit together in forming the desired permanent laminate. The present invention is particularly concerned with the nature of the photographic processing composition utilized in the photographic film units of the invention.

The light-reflecting pigments employed in the processing compositions of the invention include any of a variety of light-reflecting pigments suited to the provision of a white background for the viewing thereagainst of a diffusion transfer photographic image. The light-reflecting pigment serves to mask the developed silver halide emulsion layer or layers and helps to provide opacification protection for the developing emulsion layer or layers in the event in-light processing of a film unit is desired. While titanium dioxide is preferred, other suitable light-reflecting pigments are known and include barium sulfates, zinc oxides, alumina, zirconium oxides or the like, as described, for example, in aforementioned U.S. Pat. No. 3,647,437. Mixtures of these light-reflecting pigments can be suitably employed. Those skilled in the art will appreciate that the specific nature of the processing composition and the specific film unit often dictate the choice of light reflecting material. Within the scope of the preferred integral film unit embodiment described in detail below, titanium dioxide having a particle size of 0.18 microns available from the Dupont Corporation under the tradename R101, is preferred. In general, the light-reflecting pigment will constitute a major component of such processing compositions, usually at least 25% by weight and preferably in the range of about 35% to about 60% by weight.

The processing compositions of the present invention are aqueous alkaline compositions having a pH in excess of about 10, and frequently in the order of about 14. For film unit applications requiring pH values in the range of 12 to 14, alkaline materials such as sodium hydroxide and potassium hydroxide may be used. For applications requiring pH values in the range of 10 to 12, alkaline materials such as sodium carbonate, potassium carbonate, and borates may be used.

The processing compositions of the present invention include a thickening agent which constitutes a film-forming material of the type which, when the composition is spread and dried, forms a relatively firm and stable film. Typically, the subject processing composition comprises between 0.5 and 2.0% by weight of thickening agent—an amount sufficient to impart the processing composition with a viscosity in excess of 100 cps. (as measured at a temperature of approximately 24° C. with a Brookfield Viscometer at 2 r.p.m. using a T-shaped C spindle). Within the preferred integral film embodiment described in detail below, the viscosity of the processing composition is preferably in the order of 100,000 cps. to 250,000 cps. A viscosity of about 200,000 cps. at approximately 24° C. has been consistently reported and has been found to be satisfactory.

The thickening agents of the present invention comprise copolymers polymerized from monomer systems comprising:

(a) carboxylic acid monomers, the same or different, selected from the group consisting of: acrylic acid, methacrylic acid, ethacrylic acid, propacrylic acid and butacrylic acid; and (b) hydrophobe monomers, the same or different, represented by the formula:

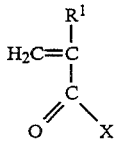

wherein $R^1$ is selected from hydrogen and alkyl having from 1 to 4 carbon atoms; and X is selected from —O—$R^2$ and —$NR^3R^4$ wherein $R^2$ is selected from: aralkyl, alkaryl and alkyl wherein the alkyl portion of each group (i.e. the alkyl portion of the aralkyl, alkaryl and alkyl groups) comprises from 8–30 carbon atoms; $R^3$ is selected from methyl and hydrogen; and when $R^3$ is methyl, $R^4$ is an alkyl group consisting of 1–18 carbon atoms; and when $R^3$ is hydrogen, $R^4$ is a tertiary alkyl group consisting of 4 to 18 carbon atoms wherein the carbon atom of attachment of the alkyl group is tertiary. The alkyl groups of the aforementioned hydrophobe monomer may be branched or unbranched, and may be substituted or unsubstituted as is known in the art. The monomer system may further include monomers, the same or different, represented by the formula:

$H_2C{=}CYZ$ wherein Y is selected from: hydrogen and an alkyl having from 1 to 4 carbon atoms, and Z is selected from the group consisting of: H, CN, Cl, $CH{=}CH_2$, and $C_6H_4R^5$ wherein $R^5$ is selected from the group consisting of: H and alkyl having from 1 to 4 carbon atoms. The alkyl groups of the aforementioned monomer may be branched or unbranched, and may be substituted or unsubstituted as is known in the art. The relative quantities of the various constituents of the thickening agent are as follows:

(a) from about 30 to 95% by weight of the carboxylic acid monomers;

(b) from about 0.1 to 40% by weight of the hydrophobe monomers;

(c) up to about 40% by weight of the monomer represented by the formula:

$H_2C{=}CYZ$ wherein Y and Z are the same as defined previously

For integral film units as described in detail below, the hydrophobe constitutes up to about 40% by weight of the thickening agent, and more preferably, from about 10–25% by weight of the thickening agent. The thickening agent also preferably includes up to about 5% by weight of a crosslinking compound, preferably a polyunsaturated crosslinking compound. Examples of suitable crosslinking compounds and methods for preparing polymers described above can be found by reference to U.S. Pat. Nos. 5,004,598; 4,996,274; 4,923,940; 4,911,736; 4,421,902; and 4,062,817.

It is thought that the hydrophobe portion of the thickening agent forms intermolecular associations with the other constituents of the processing composition. As a consequence of these intermolecular associations, the hydrophobically modified thickening agent tends to stabilize the entire composition thereby reducing pooling, i.e. preventing the formation of heterogenous layers or phases.

Hydrophobes of the present invention must be stable, i.e. not substantially hydrolyze, in the high pH of photographic processing composition used therewith. In many applications, the pH value of the composition will dictate the selection of the hydrophobe along with other various constituents of the processing composition and film unit. For example, N-substituted acrylamides having alkyl groups of 1–18 carbon atoms wherein the carbon atom of attachment of the alkyl group is tertiary, tend to be stable at pH values as high as 14. Consequently, these hydrophobes are generally preferred for processing compositions having very high pH values. Specific examples of such hydrophobes include: t-butyl acrylamide, t-butyl methacrylamide, tert-octyl acrylamide, and diacetone acrylamide.

Although typically not as resistant to hydrolysis at higher pH values, acrylic ester hydrophobes may also be used in the present invention. Examples of such hydrophobes include: decyl acrylate, isodecyl acrylate, lauroyl acrylate, stearyl acrylate, behenyl acrylate, stearyl methacrylate, 2-ethylhexyl acrylate, and nonyl phenylacrylate.

The preferred thickening agent for a high pH (in the range of about 13 to 14) photographic processing composition for use in connection with an integral film unit as described in detail below, is a crosslinked random copolymer of acrylic acid and 20% by weight of t-butyl acrylamide, e.g. ISX 1993 TM sold by the B. F. Goodrich Company. Other examples of a thickening agents within the scope of the present invention include: crosslinked random copolymers of acrylic acid and stearyl methacrylate, e.g. ISX 2390 TM and ISX 1790 TM, both sold by the B. F. Goodrich Company. It has been observed that some processing compositions including acrylic ester thickening agents (e.g. stearyl methacrylate) may exhibit some undesirable textural properties after prolonged storage in processing compositions having pH values of about 14, i.e. the formation of a mealy-type structure. The exact cause of this is not fully understood, nevertheless, these thickening agents provide advantageous results in accordance with the subject invention, particularly at processing compositions having lower pH values.

The processing compositions of the present invention may additionally include known silver halide developing agents, development restrainers, opacification dyes, tint dyes and other photographic agents typically included in such compositions. As will be understood by those skilled in the art, the selection of constituents of the processing composition along with dyes and other components of a film unit, are generally dependent upon the pH environment of the film unit. Some preferred processing compositions for integral film units operating at pH values around 13 to 14 are provided below in TABLE 1. As will be appreciated by those skilled in the art, processing compositions for peel apart film units will generally not include opacification dyes but may include small quantities of light-reflecting pigments.

The compositions can be incorporated into rupturable or frangible containers to facilitate spreading in diffusion transfer processing. Examples of suitable rupturable containers and their methods of manufacture can be found, for example, in U.S. Pat. Nos. 2,543,181; 2,634,886; 3,653,732 and 3,056,491.

Image dye-providing materials which may be employed in the present invention generally may be characterized as either (1) initially soluble or diffusible in the processing composition but are selectively rendered non-diffusible in an imagewise pattern as a function of development; or (2) initially insoluble or non-diffusible in the processing Composition but which are selectively rendered diffusible or provide a diffusible product in an imagewise distribution as a function of development. These materials may be complete dyes or dye intermediates, e.g., color couplers. The requisite differential in mobility or solubility may, for example, be obtained by a chemical action such as a redox reaction, a coupling reaction or a silver ion assisted cleavage reaction.

Examples of initially soluble or diffusible materials and their application in color diffusion transfer processes are disclosed, for example, in U.S. Pat. Nos. 2,968,554; 2,983,606; 3,087,817; 3,185,567; 3,230,082; 3,345,163; and 3,443,943. Examples of initially non-diffusible materials and their use in color transfer systems are disclosed in U.S. Pat. Nos. 3,185,567; 3,443,939; 3,443,940; 3,227,550; 3,227,552 and 4,076,529. Both types of image dye-providing substances and film units useful therewith also are discussed in the aforementioned U.S. Pat. No. 3,647,437 to which reference may be made.

A particularly useful system for forming color images by diffusion transfer is that described in U.S. Pat. No. 2,983,606, employing dye developers (dyes which are also silver halide developing agents) as the image dye-providing materials. In such systems, a photosensitive element comprising at least one silver halide layer having a dye developer associated therewith (in the same or in an adjacent layer) is developed by applying an aqueous alkaline processing composition. Development of exposed silver halide results in oxidation of the dye developer to provide an oxidation product which is appreciably less diffusible than the unreacted dye developer, thereby providing an imagewise distribution of diffusible dye developer in terms of unexposed areas of the silver halide layer, which imagewise distribution is then transferred, at least in part, by diffusion, to a dyeable stratum to impart thereto a positive dye transfer image.

Dye developers are compounds which contain the chromophoric system of a dye and also a silver halide developing function. By "a silver halide developing function" is meant a grouping adapted to develop exposed silver halide. A preferred silver halide developing function is a hydroquinonyl group. Other suitable developing functions include ortho-dihydroxyphenyl and ortho- and para-amino substituted hydroxyphenyl groups. In general, the development function includes a benzenoid developing function, that is, an aromatic developing group which forms a quinoid or quinone substance when oxidized.

Another system that is particularly useful for forming color images by diffusion transfer is that described in U.S. Pat. No. 4,740,448, which uses the aforementioned dye developer chemistry to form at least one color record and the image dye-releasing thiazolidine chemistry of U.S. Pat. No. 3,719,489 to form at least one of the other color records.

The photographic processing compositions of the present invention can be employed in a variety of diffusion transfer processes including those relating to both peel apart and integral film products and processes. The arrangement and order of the individual layers of the film units used in such processes can vary in manners known in the art. For convenience, the more specific descriptions of the invention hereinafter set forth will be by use of particular dye-image providing materials in a diffusion transfer color process and of integral film units of the type previously described. Details relating to integral film units of the type herein can be found, for example, in U.S. Pat. Nos. 3,415,644 and 3,647,437. It will be readily apparent from such descriptions that various image-forming reagents may be used, e.g., dye developers, color couplers, coupling dyes, or compounds which release a diffusible dye or dye intermediate as a result of coupling, oxidation or silver ion-assisted cleavage.

Figure 2:
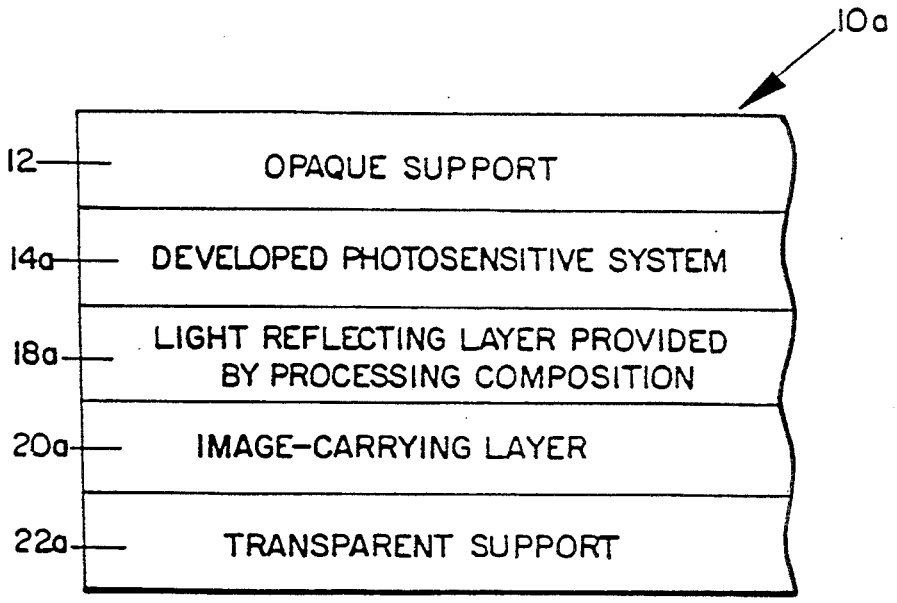
FIG. 2 is an enlarged schematic cross-sectional view of a photographic laminate of the invention formed by the processing of the film unit of FIG. 1.

Referring now to the drawing, FIG. 1 shows a photographic diffusion transfer film unit of the invention adapted to the provision of an integral positive-negative photographic laminate. The film unit 10 includes a photosensitive element comprising an opaque support 12 carrying a photosensitive system 14 which may include one or more photosensitive layers. Film unit 10 includes an image-receiving element comprising a transparent support material 22 carrying an image-receiving layer 20. The nature of support materials 12 and 22 can vary among a class of known sheet materials. A preferred support material is polyethylene terephthalate. Positioned between the photosensitive and image-receiving elements is shown a rupturable container 16 containing a processing composition 18 of the invention. After photoexposure of photosensitive system 14 through transparent support 22 and image-receiving layer 20 as shown, film unit 10 can be passed between a pair of camera rolls so as to uniformly distribute processing composition 18 between photosensitive system 14 and image-receiving layer In FIG. 2 is shown a photographic laminate of the invention **10*a* formed by exposure and processing of film unit 10 of FIG. 1. When processing composition 18 of FIG. 1 is distributed over photosensitive system 14, development of photoexposed photosensitive system 14 is initiated to establish an imagewise distribution of diffusible image-providing material which can comprise one or more dye or dye intermediate image-providing materials. The imagewise distribution of image-providing material diffuses through the spread processing composition 18 to the image-carrying layer 20*a* where it is mordanted, precipitated or otherwise retained. The spread processing composition 18 provides a light-reflecting layer 18*a*, against which the image is viewed through the transparent support The light-reflecting layer 18*a* provided by the embodiment of the invention shown in FIG. 2 is formed by solidification of the stratum of processing composition distributed after exposure. The processing composition includes a light-reflecting pigment, thickening agent, and other materials described hereinbefore. Evaporation of water from the applied layer of processing composition results in a solidified light-reflecting layer 18*a* which permits the viewing thereagainst of image layer 20*a* through transparent support 22. In addition, light-reflecting layer 18*a* serves to laminate together the developed photosensitive system 14*a* and the image-bearing layer 20 to provide the final photographic laminate 20*a***.

In accordance with one embodiment of the invention, a photographic film unit can comprise a temporary laminate including the several layers of the photographic film unit confined between two suitable supports and having the bond between a predetermined pair of layers being weaker than the bond between other pairs of layers. Thus, with reference to FIG. 1, image-receiving layer 20 can be temporarily bonded to the photosensitive layer 14 prior to exposure. The rupturable container or pod 16 can then be positioned such that, upon its rupture, the processing composition will delaminate the temporary bond and be distributed between the aforesaid layers 14 and 20. The distributed layer of processing composition upon drying forms light-reflecting layer 18*a* which serves to bond the layers together to form the desired permanent laminate. Procedures for forming such prelaminated film units, i.e., film units in which the several elements are temporarily laminated together prior to exposure, are described, for example, in U.S. Pat. Nos. 3,625,281 and 3,652,282. A particularly useful and preferred prelamination utilizes a water-soluble polyethylene glycol as described and claimed in U.S. Pat. No. 3,793,023.

If desired, the film unit shown in FIG. 1 may utilize a transparent support instead of the opaque support 12 shown therein. In accordance with this alternative embodiment, an opaque layer, e.g., pressure-sensitive, should be superposed over the transparent support to avoid further exposure through the back of the film unit during processing outside of the camera. In the embodiment illustrated in FIG. 1, photoexposure is effected through the image-receiving element. While this is a particularly useful and preferred embodiment, it will be understood that the image-receiving element may be initially positioned out of the exposure path and superposed upon the photosensitive element after photoexposure, in which event the processing and final stages would be the same as in FIG. 1.

Alternative embodiments of the subject invention are also contemplated; more specifically, integral film units of the type wherein the outermost layers of the film unit are transparent and the photosensitive layer is exposed through one surface of the film unit and the print is viewed through the opposite surface. In such film units, the processing composition often includes carbon black dispersions to provide opacification. Such film units are known in the art, an example of which is described in chapter 6 of *Imaging Processes and Materials*, Neblette's Eight Edition, Van Nostrand Reinhold, N.Y., 1989, entitled "Instant Photography and Related Reprograph Processes."

The film unit illustrated in FIG. 1 has, for convenience, been shown as a monochrome film. Multicolor images may be obtained by providing the requisite number of differentially exposable silver halide emulsions, and said silver halide emulsions are most commonly provided as individual layers coated in superposed relationship. Film units intended to provide multicolor images comprise two or more selectively sensitized silver halide layers each having associated therewith an appropriate image dye-providing material providing an image dye having spectral absorption characteristics substantially complementary to the light by which the associated silver halide is exposed. The most commonly employed negative components for forming multicolor images are of the "tri-pack" structure and contain blue-, green-, and red-sensitive silver halide layers each having associated therewith in the same or in a contiguous layer a yellow, a magenta and a cyan image dye-providing material, respectively. Interlayers or spacer layers may, if desired, be provided between the respective silver halide layers and associated image dye-providing materials or between other layers. Integral multicolor photosensitive elements of this general type are disclosed in U.S. Pat. No. 3,345,163 as well as in the previously noted U.S. Pat. Nos., e.g., in FIG. 9 of the U.S. Pat. No. 2,983,606. It should be noted, however, that film units may also utilize silver halide layers sensitized to light substantially different than the image dye-providing material associated therewith. Such systems, often referred to as "false color systems" may utilize for example, silver halide layers sensitized to infra-red wavelengths of light (generated by way of laser) for releasing visibly colored image dye-providing materials.

The dye developers (or other image dye-providing substances) are preferably selected for their ability to provide colors that are useful in carrying out subtractive color photography, that is, the previously mentioned cyan, magenta and yellow. They may be incorporated in the respective silver halide emulsion or, in the preferred embodiment, in a separate layer behind the respective silver halide emulsion. Thus a dye developer may, for example, be in a coating or layer behind the respective silver halide emulsion and such a layer of dye developer may be applied by use of a coating solution containing the respective dye developer distributed, in a concentration calculated to give the desired coverage of dye developer per unit area, in a film-forming natural, or synthetic polymer, for example, gelatin, polyvinyl alcohol, and the like, adapted to be permeated by the processing composition.

In such color diffusion transfer systems, color transfer images are obtained by exposing a photosensitive element, sometimes referred to as a "negative component", comprising at least a light-sensitive layer, e.g., a gelatin silver halide emulsion layer, having an image dye-providing material associated therewith in the same or in an adjacent layer, to form a developable image; developing this exposed element with a processing composition to form an imagewise distribution of a diffusible image dye-providing material; and transferring this imagewise distribution, at least in part, by diffusion, to a superposed image-receiving layer, often referred to as a "positive component", comprising at least a dyeable stratum to provide a color transfer image. The negative and positive components initially may be carried on separate supports which are brought together during processing and thereafter retained together as the final integral negative-positive reflection print, or they may initially comprise a unitary structure, e.g., integral negative-positive film units as previously described herein. These components may be laminated together or otherwise secured together in physical juxtaposition.

The image-receiving layer may comprise any of the materials known in the art, such as polyvinyl alcohol, gelatin, etc., preferably containing a mordant for the transferred image dye(s). If the color of the transferred image dye(s) is affected by changes in pH, the pH of the image layer may be adjusted to provide a pH affording the desired color.

In the various color diffusion transfer systems which have previously been described and which employ an aqueous alkaline processing fluid, it is well known to employ an acid-reacting reagent in a layer of the film unit to lower the environmental pH following substantial dye transfer in order to increase the image stability and/or to adjust the pH from the first pH at which the image dyes are diffusible to a second (lower) pH at which they are not. For example, the previously mentioned U.S. Pat. No. 3,415,644 discloses systems wherein the desired pH reduction may be effected by providing a polymeric acid layer adjacent the dyeable stratum. These polymeric acids may be polymers which contain acid groups, e.g., carboxylic acid and sulfonic acid groups, which are capable of forming salts with alkali; or potentially acid-yielding groups such as anhydrides or lactones. Preferably the acid polymer contains free carboxyl groups. Alternatively, the acid-reacting reagent may be in a layer adjacent the silver halide most distant from the image-receiving layer, as disclosed in U.S. Pat. No. 3,573,043. Another system for providing an acid-reacting reagent is disclosed in U.S. Pat. No. 3,576,625.

An inert interlayer or spacer layer may be used in association with the polymeric acid layer to control or "time" the pH reduction so that it is not premature and interfere with the development process. Suitable spacer or "timing" layers useful for this purpose are described with particularity in U.S. Pat. Nos. 3,362,819; 3,419,389; 3,421,893; 3,455,686; and 3,575,701.

In one embodiment of the subject invention, the opacification dyes are initially contained in the processing composition in their colored form together with the light-reflecting material, e.g., titanium dioxide. If the given opacification dye exhibits instability when stored for a period of time within a pod containing the processing composition, such dye may be used by employing a double-compartmented rupturable pod or two associated rupturable pods, such that the dye is stored separate from, e.g., the alkali, and the complete processing composition containing said dye is constituted at the time of use, in accordance with techniques well understood in the art.

The concentration of opacifying dye(s) is selected to provide the optical transmission density required, in combination with the other layers between the silver halide emulsion layer(s) and the incident radiation, to prevent non-imagewise exposure, i.e., fogging by incident actinic light during performance of the particular photographic process. The transmission density and the concentration of opacifying dye(s) necessary to provide the requisite protection from incident light may be readily determined for any photographic process by routine experimentation, as a function of film speed or sensitivity, thickness of opacification layer, processing time, anticipated incident light intensity, etc., as described in said U.S. Pat. No. 3,647,437. It will be recognized that a particular transmission density may not be required for all portions of the spectrum, lesser density being sufficient in wavelength regions corresponding to lesser sensitivities of the particular photosensitive material. A mixture of opacifying dyes may be used to obtain absorption in all critical areas of the visible and near infrared spectrum for which the silver halide emulsions being used are exposable. Examples of suitable opacification dyes are found in U.S. Pat. Nos. 3,647,347; 4,615,966; 4,891,298; and 5,244,771.

The processing composition of the preferred integral film unit as described in detail below includes a combination of the following two opacification dyes: 3-(7-n-hexadecylsulfonamidoindol-3-yl)-(6-dimethylsulfamoylindol -3 yl)naphthalide, represented by the formula:

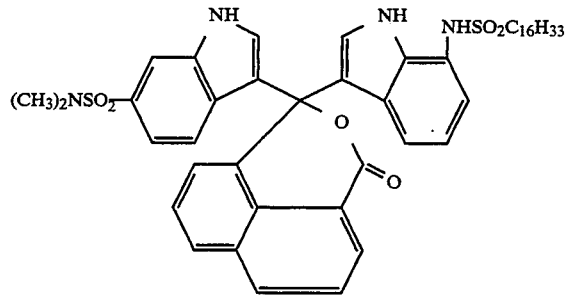

the synthesis of which may be readily determined by those skilled in the art with reference to U.S. Pat. No. 4,615,966 and; 3-(4'-hydroxy-3'-methyl-1'-phenanthryl)-3-(3''-carboxy-4''-hydroxy-7''-n-docosanyloxy-1'',-naphthyl) naphthalide, represented by the formula:

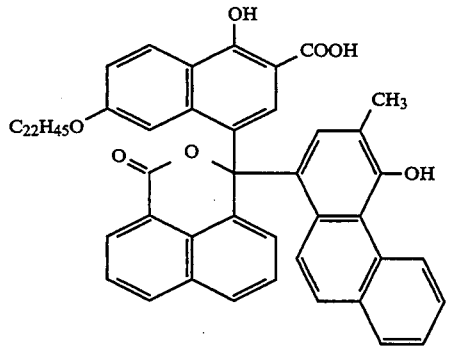

the synthesis of which is disclosed in U.S. Pat. No. 4,891,298.

The processing compositions of the present invention may also include the following active quaternary ammonium salts:

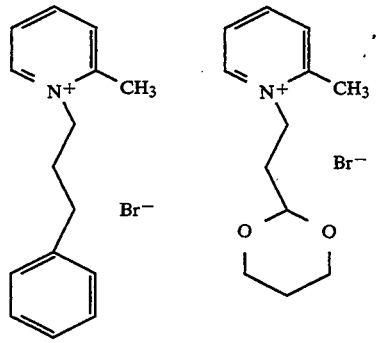

Where a light-absorbing optical filter agent (e.g. opacifying dye) is present in the processing composition, it is advantageous to utilize an image-receiving component having a surface layer adapted to decolorize the optical filter agent adjacent the interface between said component and the layer of processing composition. Suitable decolorizing layers are described in U.S. Pat. Nos. 4,298,674; 4,294,907 and 4,367,277.

As an illustration of the utility of the present invention, integral photographic film units were prepared utilizing the subject processing compositions as described in the examples presented hereinbelow. All of the examples presented herein are multicolor photosensitive elements comprising three photosensitive emulsion layers of the type generally described in U.S. Pat. No. 4,740,448, wherein each example includes a blue-sensitive silver halide emulsion which controls the yellow dye density, a green-sensitive silver halide emulsion which controls the magenta dye density, and a red sensitive silver halide emulsion which controls the cyan dye density. Each of the examples represent substantially identical photographic film units but for the presence of different thickening agents utilized in the processing compositions thereof. It is noted, that although efforts to keep the constituents of each component of the example film units identical, there are small variances in the actual amounts and coverages between examples.

Integral photographic film units may be prepared in the manner described below. It will be appreciated by those skilled in the art that various surfactants and bacteriostats are typically required in the coating techniques described herein. Multicolor photosensitive elements may be prepared by coating the following layers, in succession, onto an opaque subcoated polyethylene terephthalate film of approximately 4 mil thickness.

1. A polymeric acid layer comprising from about 20,000–24,000 mg/m$^2$ of a partial butyl ester of ethylene maleic anhydride, about 4310 mg/m$^2$ of polyvinyl butyral, and about 89 mg/m$^2$ of titanium dioxide;

2. a timing layer comprising a 49.1/30/10/3.7/7.2 pentapolymer of: butylacrylate/diacetone acrylamide/carbomethoxy methyl acrylate/methylacrylic acid/methylmethacrylate coated at a coverage of about 2600 mg/m$^2$, and a quantity of sodium hydroxide sufficient to impart a pH to the layer of about 7.2;

3. a cyan dye developer layer comprising about 443 mg/m$^2$ of the cyan dye developer represented by the formula:

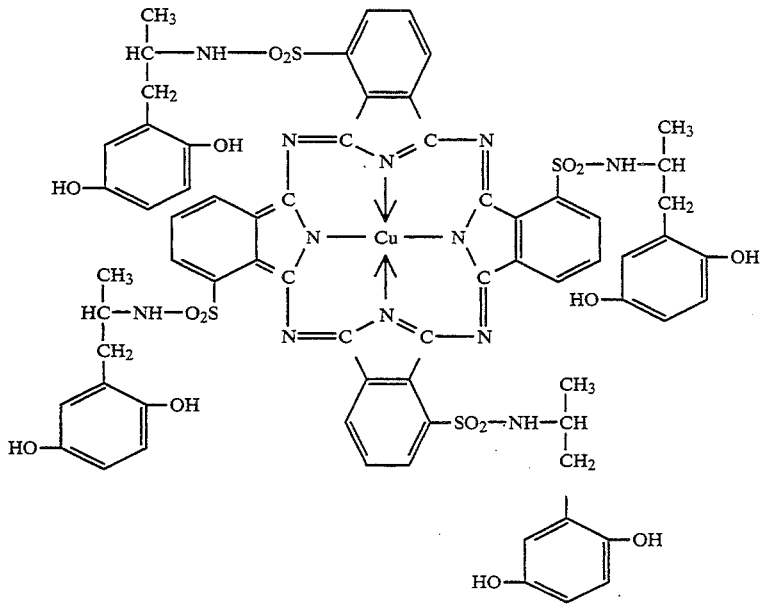

about 395 mg/m$^2$ of gelatin, about 106 mg/m$^2$ of 4'-methylphenyl hydroquinone (MPHQ), about 62 mg/m$^2$ of 1,3 -bis[1-(4-hydroxyphenyl)-tetraxolyl-(5)-mercapto]-2-propanone oxime, about 1–5 mg/m$^2$ of ascorbyl palmitate, about 264 mg/m$^2$ of tricresyl phosphate, a sufficient quantity of sodium cellulose sulfate to obtain a viscosity of about 100 to 150 cps, and about 20 mg/m$^2$ of bis(6-benzoylaminopurine) zinc;

4. a layer comprising about 400 mg/m$^2$ of titanium dioxide, about 150 mg/m$^2$ of a 29.6/60.1/6.2/3.7/0.4 pentapolymer of butylacrylate/diacetone acrylamide/methylacrylic acid/styrene/acrylic acid, about 50 mg/m$^2$ of gelatin, and about 150 mg/m$^2$ of polymethylmethacrylate latex;

5. a red-sensitive silver iodobromide layer comprising about 917 mg/m$^2$ of silver (1.5 microns) and about 550 mg/m$^2$ of gelatin;

6. an interlayer comprising about 2880 mg/m$^2$ of the pentapolymer described in layer 4, about 120 mg/m$^2$ of polyacrylamide, about 246 mg/m$^2$ of 1-hydroxylmethyl-5,5-dimethylhydantoin, and about 2 mg/m$^2$ of succinaldehyde;

7. a magenta dye developer layer comprising about 334 mg/m$^2$ of the magenta dye developer represented by the formula:

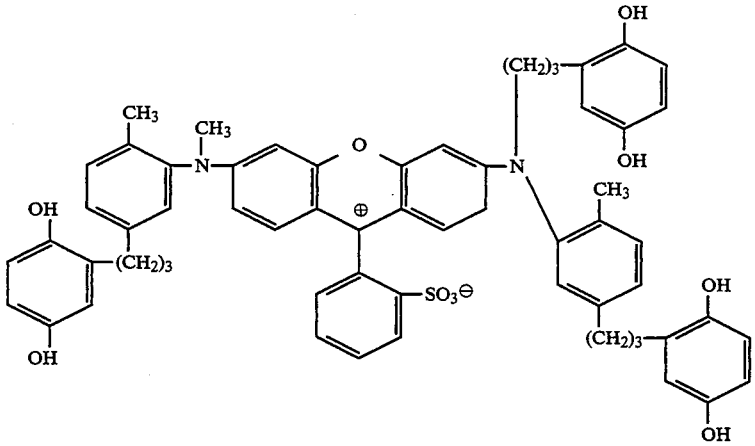

about 181 mg/m$^2$ of gelatin, and about 65 mg/m$^2$ of bis(6-benzylaminopurine) zinc;

8. about 1100 mg/m$^2$ of titanium dioxide (0.18 microns available from Dupont as R101), about 412 mg/m$^2$ of methyl methacrylate latex, about 138 mg/m$^2$ of gelatin, and about 412 mg/m$^2$ of the pentapolymer described in layer 4;

9. a green-sensitive silver halide emulsion layer comprising about 565 mg/m$^2$ of silver (1.3 microns), about 565 mg/m$^2$ of silver (1.1 microns), and about 439 mg/m$^2$ of gelatin;

10. about 181 mg/m$^2$ of MPHQ, about 500 mg/m$^2$tricresyl phosphate, about 158 mg/m$^2$ of 2-phenylbenzimidazole, about 82 mg/m$^2$ of 1,3-bis[1-(4-hydroxyphenyl)-tetrazolyl-(5)-mercapto]-2-propanone oxime, and about 317 mg/m$^2$ of gelatin;

11. about 1815 mg/m$^2$ of the pentapolymer described in layer 4, about 124 mg/m$^2$ of 1-hydroxymethyl-5,5-dimethylhydantoin, and about 2 mg/m$^2$ of succinaldehyde;

12. about 1250 mg/m$^2$ of scavenger represented by the formula:

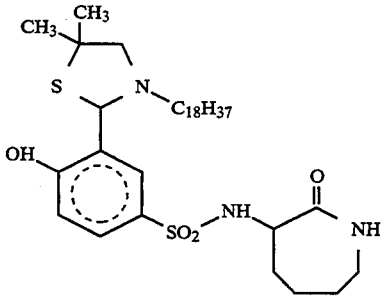

about 1083 mg/m$^2$ of styrene-acrylate latex, about 67 mg/m$^2$ of TAMOL-731 TM (surfactant available from the Rohm Haas Co.), and about 553 mg/m$^2$ of gelatin;

13. a layer comprising about 418 mg/m$^2$ of benzidine yellow dye and about 209 mg/m$^2$ of gelatin;

14. a yellow image dye-providing layer comprising about 840 mg/m$^2$ of a yellow image dye-providing material represented by the formula:

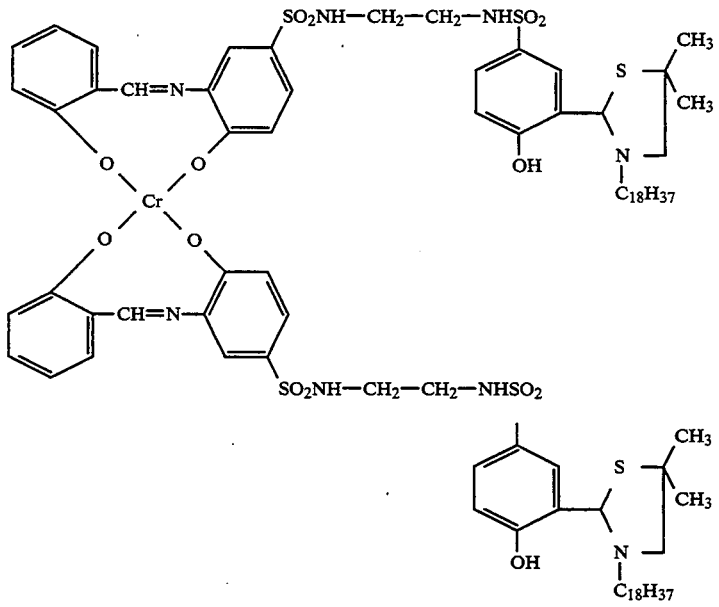

and about 336 mg/m$^2$ of gelatin;

15. a layer comprising about 522 mg/m$^2$ of phenyl tertiarybutyl hydroquinone, about 284 mg/m$^2$ of gelatin, and about 38 mg/m$^2$ of 2-t-butyl-5,6-diPMT hydroquinone-di(methylsulfo-ethylcarbonate);

16. a blue-sensitive silver iodobromide layer comprising about 245 mg/m$^2$ of silver (1.6 microns) and about 122 mg/m$^2$ of gelatin; and 17. 389 mg/m$^2$ of 2-(2-hydroxy-3,4-di(1,1-dimethylbenzyl)phenyl)-2H-benzotriazole and about 335 mg/m$^2$ of gelatin.

An image-receiving element may be prepared by obtaining an approximately 3.5 mil polyethylene terephthalate film base including cyan and magenta an antilight piping dyes and an ultra violet absorbing dye (available from the Imperial Chemical Industries Americas Co.), upon which the following layers are coated in succession:

1. an image-receiving layer coated at a coverage of about 300 mgs/ft$^2$ (3229 mgs/m$^2$) of a graft copolymer comprised of 4-vinylpyridine (4VP) and vinyl benzyl trimethylammonium chloride (TMO) grafted onto hydroxyethyl cellulose (HEC) at ratios of HEC/4VP/TMQ of 2.2/2.2/1 and about 5 mgs/ft$^2$ (54 mgs/m$^2$) of 1,4-butanediol-diglycidyl ether; and 2. an overcoat layer coated at a coverage of about 85 mgs/ft$^2$ (915 mgs/m$^2$) comprising 1 part Igepal CO-997 (nonylphenoxyethylene oxide ethanol), 1 part of a 1.0/1.0/0.1/0.1 tetrapolymer of methacrylic acid/diacetone acrylamide/butyl acrylate/styrene and 0.3 part of polyvinylpyrrolidone.

The photosensitive element is placed in a superposed relationship with the image receiving element with their respective supports outermost and a rupturable container retaining an aqueous alkaline processing composition fixedly mounted at the leading edge of the superposed elements, by pressure-sensitive or heat-sensitive tapes to make a film unit, so that, upon application of compressive force to the container to rupture the marginal seal of the container, the contents thereof would be distributed between the superposed elements.

The aqueous alkaline processing composition of the examples provided herein all comprised the constituents and relative amounts as provided in TABLE 1.

TABLE 1

| Constituents | Parts by weight % |
|---|---|
| Water | 42.7 |
| Titanium dioxide | 43.0 |
| Potassium hydroxide | 5.7 |
| Colloidal silica | 0.6 |
| *Thickening agent | 1.0 |
| N-ethyl dioxanyl alpha picolinium bromide | 1.3 |
| N-phenyl propyl alpha picolinium bromide | 0.3 |
| Transexamic acid (trans-4-aminomethyl cyclohexane carboxylic acid) | 0.2 |
| 6-methyl uracil | 0.5 |
| Hypoxanthine | 0.7 |
| Hydroxy PMT (hydroxy phenyl mercaptotetrazole) | 0.02 |
| 2-ethylimidazole | 1.5 |
| 3,5-dimethyl pyrazole | 0.06 |
| PMT (phenyl mercaptotetrazole) | 0.0005 |
| Sodium salt of paratoluene sulfinic acid | 0.5 |
| 3-(7-n-hexadecylsulfonamidoindol-3-yl)-(6-dimethylsulfamoylindol-3-yl)naphthalide | 0.3 |
| 3-(4'-hydroxy-3'-methyl-1'-phenanthryl)-3-(3''-carboxy-4''-hydroxy-7''-n-docosanyloxy-1''-naphthyl)naphthalide | 1.8 |

TABLE 1-continued

The only variance among the examples provided herein, but for small variances between coverage amounts, was the type of thickening agent used in the processing composition. The specific thickening agent used for each example is identified in TABLE 2 provided below.

The pooling of each of the example photographic processing compositions was measured and is recorded in TABLE 2. Pooling was measured by measuring out equal volumes of each processing composition into individual 3 mm diameter Wintrobe tubes, sealing each tube and centrifuging for approximately 10 minutes. (The particular centrifuge used for the examples provided herein positioned the sample tubes at a 45 degree angle, and was operated at a rotational speed which subjected the top portion of each tube to a force of approximately 380 G and the bottom of each tube to approximately 1090 G.) Subsequently, the tubes were removed and both the total height of the contents of the inside of the tube and the height of the pooled fluid were measured. The amount of pooling is expressed as percent pooling by dividing the pool height by the total height and multiplying the resulting number by 100.

TABLE 2

| (Example No.) | Thickening Agent | % Pooling |
|---|---|---|
| (1) | Carbopol 940 TM (crosslinked polyacrylic acid) | 22 |
| (2) | ISX 1993 TM (crosslinked random copolymer of acrylic acid and 20% by wt. t-butyl acrylamide) | 0–1 |
| (3) | ISX 1790 TM (crosslinked random copolymer of acrylic acid and 15% by wt. stearyl methacrylate) | 0–1 |
| (4) | ISX 2390 TM (crosslinked random copolymer of acrylic acid and 10% by wt. stearyl methacrylate) | 0–1 |

As indicated by the data shown in Table 2, pooling was significantly reduced in processing compositions utilizing thickening agents which were hydrophobically modified. More specifically, utilization of thickening agents copolymerized with the hydrophobe and carboxylic acid monomers of the present invention, resulted in a photographic processing compositions having lower percentages of pooling.

In order evaluate photographic quality of film units including processing compositions including the subject thickening agents, integral color film units were prepared in a manner substantially similar to that described above. Four film units were prepared, each utilizing one of the thickening agents provided in Table 2. Photosensitometric testing was performed on each example film unit by photoexposing each film unit through the image-receiving element using an exposure of 0.5 meter-candle seconds through a standardized wedge target. The processing composition was distributed between the elements of each film unit by pressing the film unit between a pair of pressure-applying rollers having a gap of approximately 0.071 mm, as generally described above. The resulting laminate was maintained intact to provide a multicolor integral negative-positive reflection print which exhibited good color quality and balance. Each example provided good optical densities.

Many modification and variations of the subject invention are possible in light of the above teachings. It is therefore, to be understood that within the scope of the appended claims, the invention may be practiced otherwise than as specifically described.

What is claimed:

1. A photographic processing composition comprising an aqueous alkaline medium having a pH in excess of 10 and including a thickening agent therein, said thickening agent comprising a copolymer polymerized from a monomer system comprising:

(a) carboxylic acid monomers, the same or different, selected from the group consisting of: acrylic acid, methacrylic acid, ethacrylic acid, propacrylic acid and butacrylic acid; and (b) hydrophobe monomers, the same or different, represented by the formula:

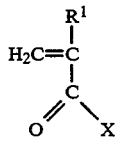

wherein $R^1$ is selected from hydrogen and alkyl having from 1 to 4 carbon atoms; and X is selected from —O—$R^2$ and —$NR^3R^4$ wherein $R^2$ is selected from: aralkyl, alkaryl and alkyl wherein said alkyl portion of each group comprises from 8–30 carbon atoms; $R^3$ is selected from methyl and hydrogen; and when $R^3$ is methyl, $R^4$ is an alkyl group consisting of 1–18 carbon atoms; and when $R^3$ is hydrogen, $R^4$ is a tertiary alkyl group consisting of 4 to 18 carbon atoms wherein the carbon atom of attachment of said alkyl group is tertiary.

2. A composition as set forth in claim 1 wherein the monomer system of said copolymer further includes monomers, the same or different, represented by the formula:

$H_2C{=}CYZ$ wherein Y is selected from: hydrogen and an alkyl having from 1 to 4 carbon atoms, and Z is selected from the group consisting of: H, CN, Cl, $CH{=}CH_2$, and $C_6H_4R^5$ wherein $R^5$ is selected from the group consisting of: H and alkyl having from 1 to 4 carbon atoms.

3. A composition as set forth in claim 1 wherein said thickening agent further includes a crosslinking compound.

4. A composition as set forth in claim 3 wherein said crosslinking compound is polyunsaturated.

5. A composition as set forth in claim 2 wherein said copolymer comprises:

(a) from about 30 to 95% by weight of said carboxylic acid monomers;

(b) from about 0.1 to 40% by weight of said hydrophobe monomers;

(c) up to about 40% by weight of said monomer represented by the formula:

$H_2C{=}CYZ$ wherein Y and Z are the same as defined in claim 2; and (d) up to about 5% by weight of a crosslinking compound.

6. A composition as set forth in claim 1 wherein said hydrophobe monomer constitutes greater than 5% by weight of said thickening agent.

7. A composition as set forth in claim 1 wherein said thickening agent is a random copolymer.

8. A composition as set forth in claim 1 wherein said thickening agent is a crosslinked random copolymer of acrylic acid and t-butyl acrylamide.

9. A composition as set forth in claim 1 wherein said thickening agent is a crosslinked random copolymer of acrylic acid and stearyl methacrylate.

10. A composition as set forth in claim 1 wherein said aqueous alkaline medium has a pH greater than 12.

11. A composition as set forth in claim 1 further including at least one of the following active quaternary ammonium salts represented by the formulae:

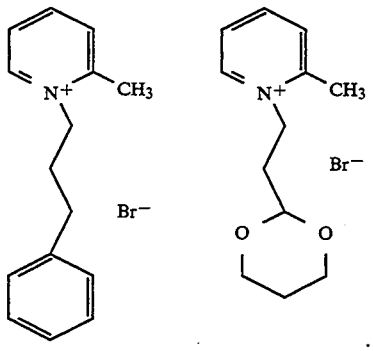

12. A composition as set forth in claim 1 further including at least one of the following opacification dyes represented by the formulae:

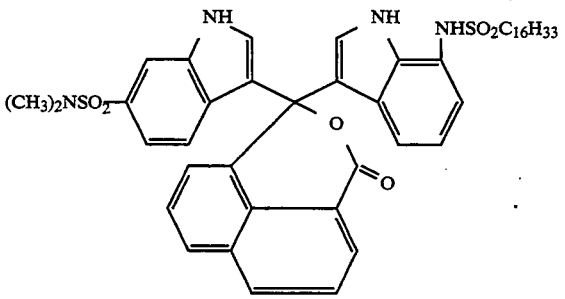

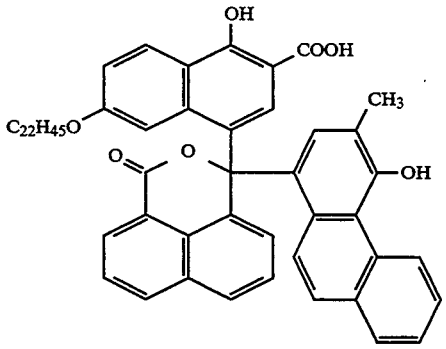

13. A composition as set forth in claim 1 further including a light-reflecting pigment.

* * * * *